US009394663B2

(12) United States Patent
Berger

(10) Patent No.: US 9,394,663 B2
(45) Date of Patent: Jul. 19, 2016

(54) GROUND ANCHOR

(71) Applicant: Darcy Berger, Bargara (AU)

(72) Inventor: Darcy Berger, Bargara (AU)

( * ) Notice: Subject to any disclaimer, the term of this patent is extended or adjusted under 35 U.S.C. 154(b) by 0 days.

(21) Appl. No.: 14/642,020

(22) Filed: Mar. 9, 2015

(65) Prior Publication Data

US 2015/0252546 A1 Sep. 10, 2015

(30) Foreign Application Priority Data

Mar. 7, 2014 (CA) ..... 2845106

(51) Int. Cl.
*E02D 5/80* (2006.01)
*E04H 12/22* (2006.01)

(52) U.S. Cl.
CPC ..... *E02D 5/803* (2013.01); *E04H 12/2215* (2013.01)

(58) Field of Classification Search
CPC ..... E02D 5/80; E02D 5/803
USPC ..... 52/155, 156, 158, 159, 160
See application file for complete search history.

(56) References Cited

U.S. PATENT DOCUMENTS 804,900 A 11/1905 Templeman
1,606,146 A * 11/1926 Cole ..... E02D 5/803 52/161
1,948,856 A * 2/1934 Heinrich ..... E02D 5/803 52/161
2,340,447 A * 2/1944 Aiken ..... E02D 5/803 52/162
3,187,858 A * 6/1965 Des Champs ..... E02D 5/54 52/160
3,855,745 A * 12/1974 Patterson ..... E02D 5/805 405/244
4,189,879 A * 2/1980 Patterson ..... E02D 5/803 52/161
4,251,963 A 2/1981 Patterson
4,436,214 A * 3/1984 Henderson ..... E05G 1/005 220/475
4,547,106 A * 10/1985 Lipsker ..... E02D 5/803 405/237
4,592,178 A * 6/1986 Lu ..... E02D 5/803 405/248
4,697,394 A * 10/1987 Lu ..... E02D 5/803 411/432
4,882,891 A * 11/1989 Sero ..... E02D 5/72 405/229
5,058,337 A 10/1991 O'Connor
5,161,561 A 11/1992 Jamieson
7,497,053 B2 * 3/2009 Nicolet ..... E02D 5/74 248/545
2004/0115009 A1 6/2004 Bradley et al.

FOREIGN PATENT DOCUMENTS

DE 4026781 A1 7/1991
WO 2012/134263 A1 10/2012

* cited by examiner

*Primary Examiner* — Brian Glessner
*Assistant Examiner* — Adam Barlow
(74) *Attorney, Agent, or Firm* — Seed IP Law Group PLLC

(57) ABSTRACT

A ground anchor has an anchor body with a ground insertion end and a surface end that remains accessible from above the ground surface when the body is inserted into the ground. Arms are pivotally connected to the anchor body and have an installation position, a ready position, and a deployed position. A first actuator moves the arms from the installation position to the ready position. In the ready position, an upward force applied to the anchor body causes the deployment profile to engage the ground material, the ground material causing the one or more arms to move to the deployed position in which the one or more arms extend outward from the anchor body and into the ground material.

20 Claims, 19 Drawing Sheets

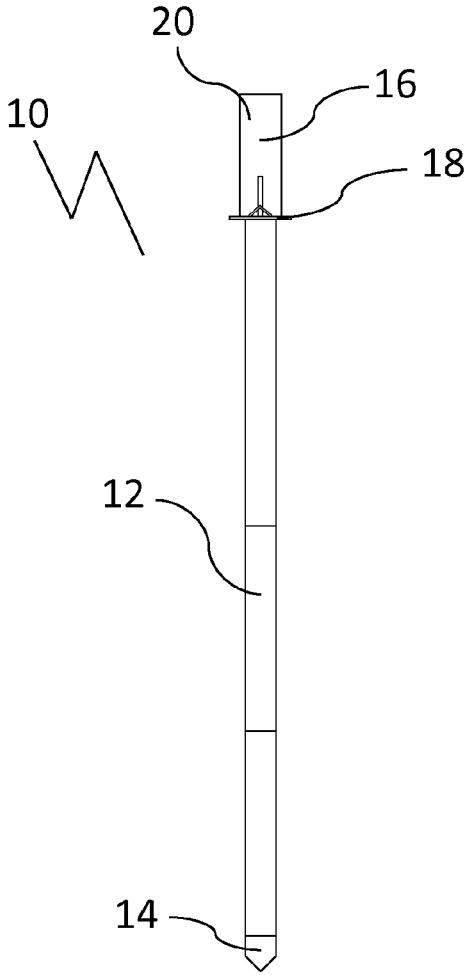
FIG. 2
FIG. 3
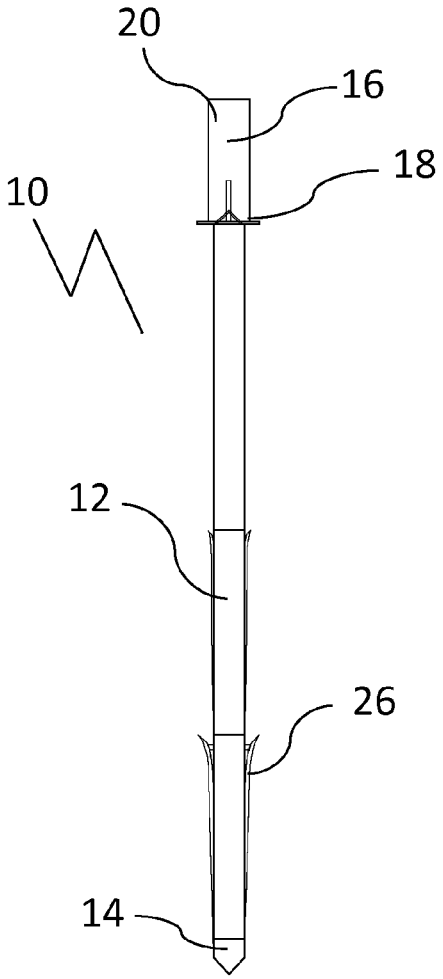

GROUND ANCHOR

BACKGROUND

1. Technical Field

This relates to a ground anchor that provides an anchor for an object to be secured.

2. Description of the Related Art

It is often desirable to provide a ground anchor that can be used to secure objects. For example, at a beach or other recreational area where other structures are unavailable, it may be desirable to secure valuables or other objects to a portable ground anchor. U.S. Pat. No. 4,189,879 (Patterson) entitled "Earth Anchor" describes an anchor that have anchor arms that extend out in order to secure the anchor in place. U.S. Pat. No. 4,436,214 (Henderson) entitled "Anti-theft picnic device" describes teeth that extend out from the locking pin, and that has a loop at the top to which items may be locked.

BRIEF SUMMARY

There is provided a ground anchor comprising an anchor body having a ground insertion end and a surface end. In use the ground insertion end is inserted into a ground surface and the surface end remaining accessible from above the ground surface. There are one or more arms that each have a first end that is pivotally connected to the anchor body at a pivot point and a second end opposite the first end. The one or more arms have an installation position, a ready position, and a deployed position. A first actuator moves the arms from the installation position to the ready position. In the installation position, the one or more arms extend along the anchor body from the pivot point toward the surface end, and moving the arms to the ready position wherein the one or more arms are provided with a deployment profile. In the ready position, an upward force applied to the anchor body causes the deployment profile to engage the ground material, the ground material causing the one or more arms to move to the deployed position in which the one or more arms extend outward from the anchor body and into the ground material.

According to another aspect, the ground anchor may further comprise a deployed linkage that holds the arms in the deployed position, and a second actuator that releases the deployed linkage such that, when released, a further upward force applied to the body pivots the one or more arms to a removal position wherein the locking arms extend along the anchor body away from the surface end relative to the ground insertion end.

According to another aspect, the anchor body may be a hollow body and the first actuator may be an actuator bar that is inserted within the hollow body, the actuator bar having a lower engagement profile that moves the arms from the installation position to the ready position and secures the arms when in the deployed position.

According to another aspect, the arms may be released from the deployed position by removing the actuator bar.

According to another aspect, the ground insertion end is telescoping and removable from the surface end.

According to another aspect, the ground anchor body may be hollow and the insertion end may be selectively openable to release ground material within the anchor body when the ground anchor body is removed.

According to another aspect, the ground anchor may comprise a first set of arms and a second set of arms spaced axially along the anchor body from the first set of arms.

According to an aspect, the first actuator may comprise a rotating handle at the surface end of the anchor body.

According to another aspect, the first actuator may comprise a pivoting handle at the surface end of the anchor body.

According to another aspect, the first actuator may comprise a locking profile that, when engaged, prevents the first actuator from moving the one or more arms from the ready position to the installation position.

According to another aspect, the anchor body may comprise a first section and a second section and the anchor body is collapsible. The first and second sections may be connected by a hinge and collapsing the anchor body comprises folding the anchor body about the hinge.

According to another aspect, the surface end may comprise an anvil surface.

According to another aspect, the surface end may comprise one or more flanges that extend out from the anchor body. The one or more flanges may comprise locking profiles for selectively locking objects to the anchor body.

According to another aspect, the deployment profile may be provided by moving each arm or an end of each arm outward to a degree that each arm or end of each arm is retractable to the installation position using the first actuator.

According to another aspect, in the installation position, the one or more arms may be pivotally locked to the anchor body, and in the ready position, the one or more arms may be free to pivot about the pivot point to the deployed position.

According to another aspect, the ground anchor may further comprise an alarm circuit that is activated when the first actuator is actuated to the ready position and the arms are deployed.

According to another aspect, the first actuator may further move the arms from the ready position back to the installation position.

According to a further aspect, there is provided a method of providing a ground anchor. The method comprises the step of providing an anchor body having a ground insertion end and a surface end and one or more arms, each arm having a first end that is pivotally connected to the anchor body at a pivot point and a second end opposite the first end, the one or more arms having an installation position, a ready position, and a deployed position. The ground insertion end is inserted into a ground surface such that the surface end remains accessible from above the ground surface, the arms being in an installation position such that the one or more arms extend along the anchor body from the pivot point toward the surface end. Using a first actuator, the arms are moved from the installation position to the ready position such that the one or more arms have a deployment profile. If an upward force is applied to the anchor body in the ready position, the deployment profile is permitted to engage the ground material such that the ground material causes the one or more arms to move to the deployed position in which the one or more arms extend outward from the anchor body and to engage the ground material. According to another aspect, the one or more arms may be held in the deployed position by a deployed linkage and the method may further comprise the steps of: releasing the deployed linkage using a second actuator; and applying a further upward force to the body to cause the one or more arms to pivot to a removal position wherein the locking arms extend along the anchor body away from the surface end relative to the ground insertion end.

According to another aspect, the anchor body may be a hollow body and the first actuator may be an actuator bar that is inserted within the hollow body, the actuator bar having a lower engagement profile that moves the arms from the installation position to the ready position and secures the arms when in the deployed position.

According to another aspect, the arms may be released from the deployed position by removing the actuator bar.

According to another aspect, the ground insertion end may be telescoping and removable from the surface end.

According to another aspect, the ground anchor body may be hollow and the method may further comprise the step of opening the insertion end to release ground material within the anchor body when the ground anchor body is removed.

According to another aspect, there may be a first set of arms and a second set of arms spaced axially along the anchor body from the first set of arms.

According to another aspect, the first actuator may comprise a rotating handle at the surface end of the anchor body.

According to another aspect, the first actuator may comprise a pivoting handle at the surface end of the anchor body.

According to another aspect, the first actuator may comprise a locking profile that, when engaged, prevents the first actuator from moving the one or more arms from the ready position to the installation position.

According to another aspect, the anchor body may comprise a first section and a second section and further comprising the step of collapsing the anchor body. The first and second sections may be connected by a hinge and collapsing the anchor body is collapsed by folding the anchor body about the hinge.

According to another aspect, the surface end may comprise an anvil surface and the method may further comprise the step of driving the anchor body into the ground by applying a striking force to the anvil surface.

According to another aspect, the surface end may comprise one or more flanges that extend out from the anchor body, the one or more flanges comprising at least one locking profile, and further comprising the step of locking an object to at least one of the locking profiles.

According to another aspect, the deployment profile may be provided by moving each arm or an end of each arm outward to a degree that each arm or end of each arm is retractable to the installation position using the first actuator.

According to another aspect, in the installation position, the one or more arms are pivotally locked to the anchor body, and in the ready position, the one or more arms are free to pivot about the pivot point to the deployed position.

According to another aspect, the method may further comprise the step of sounding an alarm when the arms move to the deployed position.

According to another aspect, if the one or more arms are not moved to the deployed position, the arms may be moved from the ready position to the installation position using the first actuator and the anchor body may be removed from the ground.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 2 is a side elevation view of the ground anchor in the installation position.

FIG. 3 is a side elevation view of the ground anchor in the ready position.

DETAILED DESCRIPTION

Figure 1:
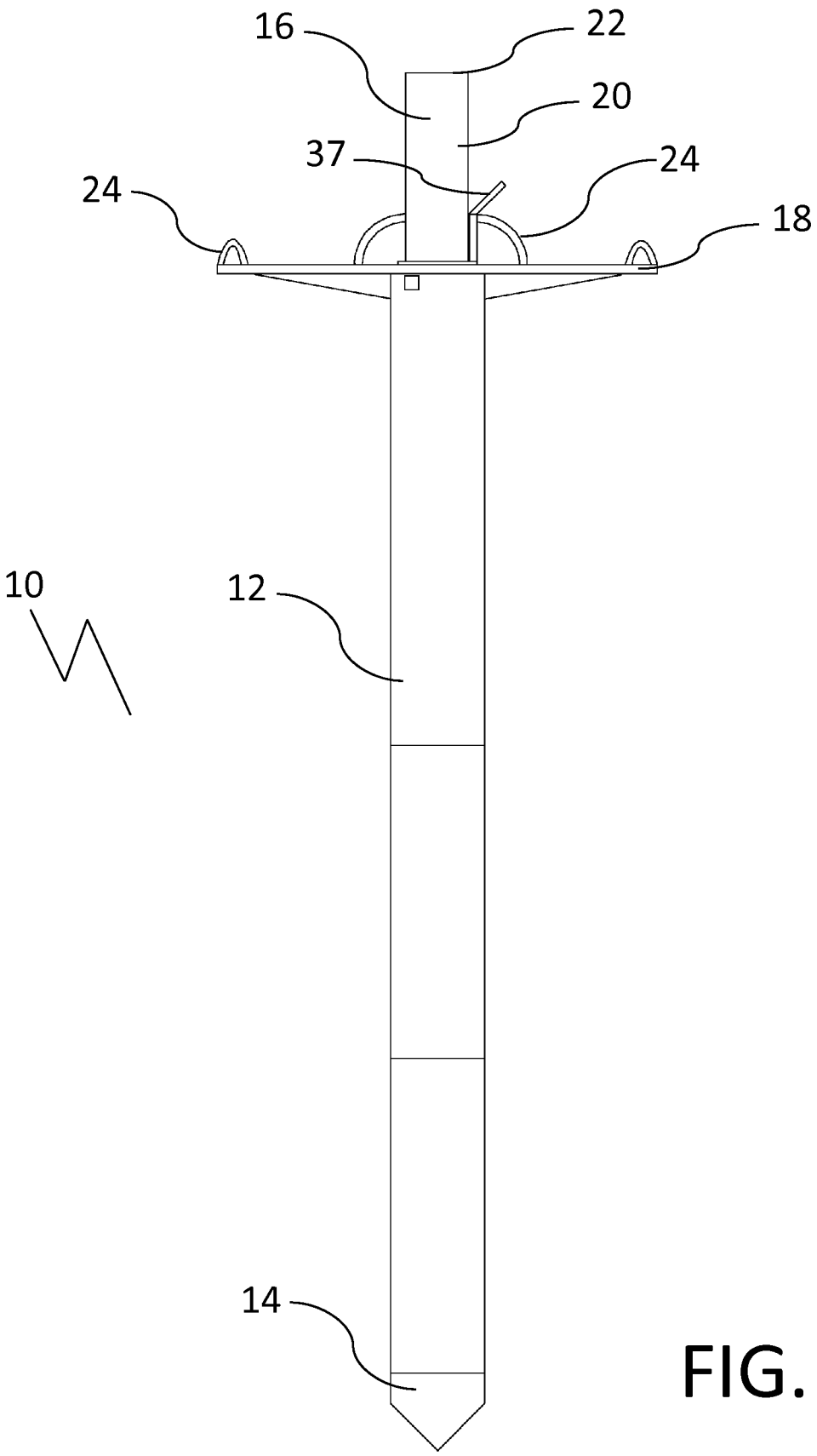
FIG. 1 is a front elevation view of the ground anchor.

A ground anchor generally identified by reference numeral 10, will now be described with reference to FIGS. 1 through 31. A first embodiment will be described with reference to FIGS. 1 through 24, and a second embodiment with reference to FIGS. 25 through 32.

Structure and Relationship of Parts:

Referring to FIG. 1, ground anchor 10 has an anchor body 12 with a ground insertion end 14 and a surface end 16. Ground insertion end 14 is intended to be inserted into a ground surface with surface end 16 remaining accessible from above the ground surface. Preferably, ground insertion end 14 is pointed to make it easier to insert into the ground. Surface end 16 is preferably large enough to allow a user to handle ground anchor 10, and is shown as having horizontal handles or flanges 18 extending out the sides of surface end 16 as well as a vertical handle 20 extending out the top. Vertical handle 20 preferably has an anvil surface 22 that can be used to pound in anchor body 12, such as with a hammer or mallet if necessary. Surface end 16 also preferably has various anchor points or profiles 24 that can be used to lock items to ground anchor 10. These can be positioned on or adjacent to vertical handle 20 at the ends of horizontal handles 18, or in any convenient location. It is preferred that anchor points 24 be accessible once ground anchor is installed by positioning them on top of horizontal handles 18.

Figure 4:
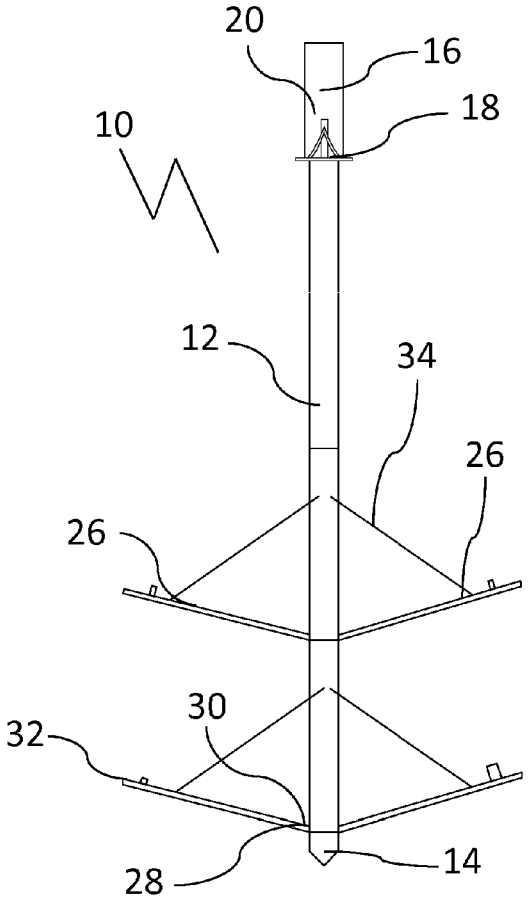
FIG. 4 is a side elevation view of the ground anchor in the deployed position.
Figure 7:
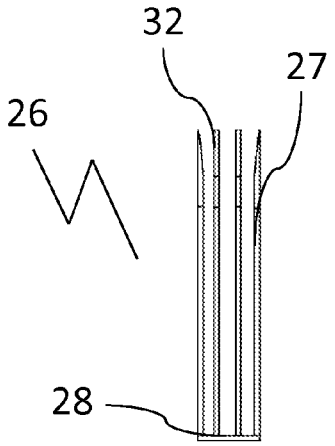
FIG. 7 is a detailed side elevation view of an anchor arm in the installation position.
Figure 8:
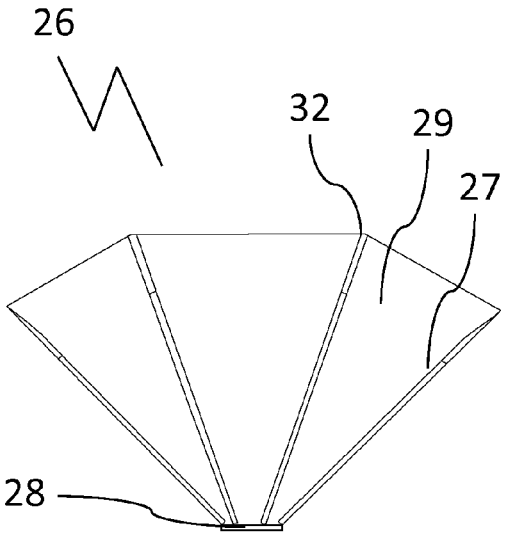
FIG. 8 is a detailed side elevation view of an anchor arm in the deployed position.

Referring to FIGS. 3 and 4, ground anchor 10 also has one or more arms 26 that are designed to engage the ground surface and prevent the removal of ground anchor 10 when installed. Each arm 26 has a first end 28 that is pivotally connected to anchor body 12 at a pivot point 30 and a second end 32 opposite first end 28. Second end 30 extends toward surface end 16 relative to first end 28. As shown, arms 26 are preferably provided on either side of anchor body 12 and there may be more than one set of arms spaced axially along the length of anchor body 12. Referring to FIGS. 7 and 8, an example of an anchor arm 26 is shown. Arm 26 is made up of a plurality of load bearing members 27 connected by a flexible substrate 29. As arm 26 is deployed, load bearing members 27 fold outward, preferably at an angle relative to the others to make use of flexible substrate 29. As there are many types of ground anchors, it will be understood that the depicted anchor arm 26 is for illustrative purposes, and that other types of anchor arms 26 may be substituted and achieve adequate results. However, the depicted example provides a large surface area and is capable of moving to a release position as will be described below.

Figure 6:
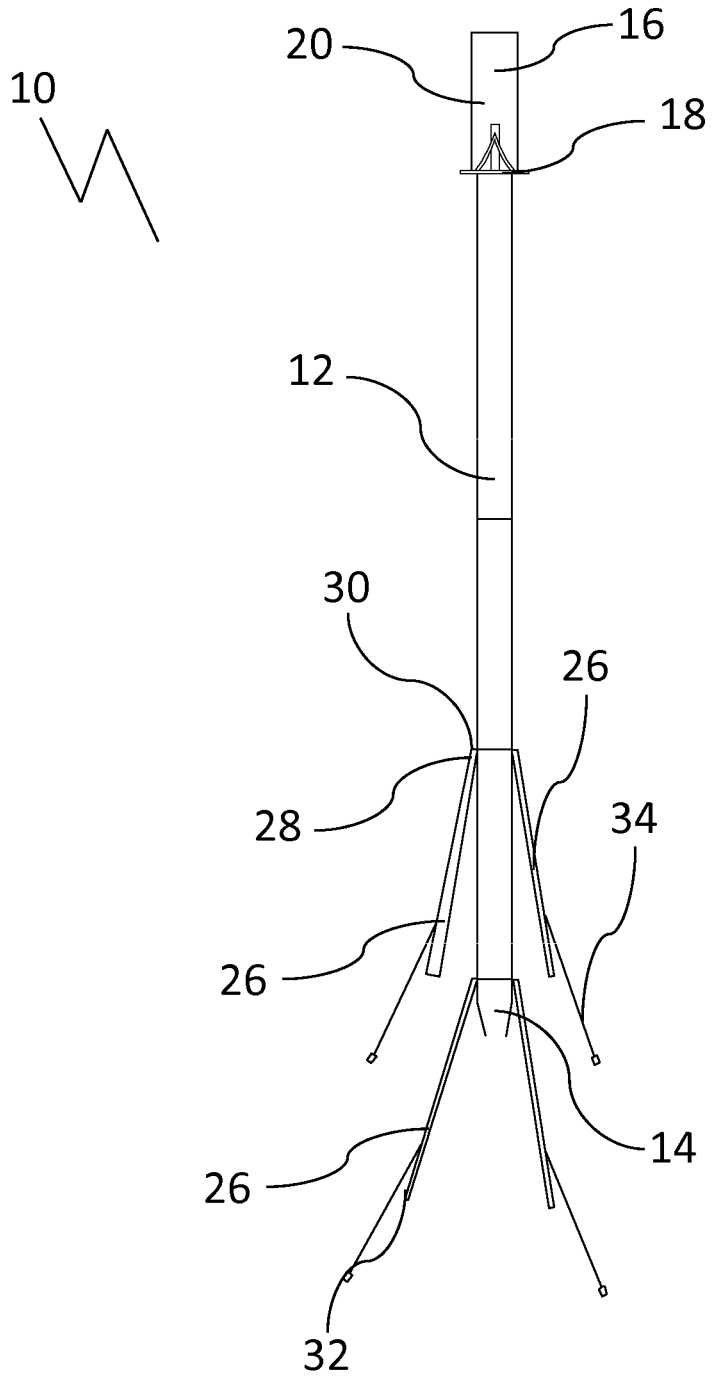
FIG. 6 is a side elevation view of the ground anchor in the release position.
Figure 9:
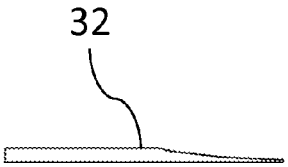
FIG. 9 is a detailed side elevation view of an end of an anchor arm.

Arms 26 have an installation position shown in FIG. 2, a ready position shown in FIG. 3, a deployed position shown in FIG. 4 and preferably a release position shown in FIG. 6. Referring to FIG. 3, in the ready position, arms 26 are prepared to engage a ground surface, but are not fully deployed. As such, arms 26 may be retracted from the ready position and return to the installation position. In the ready position, arms 26 have a deployment profile that can engage the ground surface. Referring to FIG. 9, the deployment profile may be a tapered end that engages the ground surface as it moves through the ground surface. In some circumstances, moving to the ready position may involve releasing a pivotal lock on pivot point 30 or arms 26, such that they are permitted to pivot when a load is applied. In other circumstances, moving to the ready position may involve moving arms 26 outward sufficient to be able to engage the ground, but not so far as to make arms 26 unable to be returned to the installation position from the ready position. Other ways to place arms 26 in a ready position that can be reversed to the installation position will be recognized by those skilled in the art.

As an upward force is applied to the ground anchor, the deployment profile will engage the ground, and arms 26 will be pivoted around pivot point 30. A relatively small amount of force is required to begin the deployment process, as arms 26 are free to pivot about pivot point 30 in the ready position. Once deployed, arms 26 engage the ground surface in such a manner that a significant force is required, which will generally be beyond the capabilities of an individual. By providing three positions, a user is able to provide an anchor by inserting ground anchor 10 into the ground and moving arms 26 to the ready position. Once in the ready position, arms 26 will only be moved to the deployed position if someone attempts to remove ground anchor 10 without returning arms 26 to the installation position. If a force is not applied to ground anchor 10, arms 26 will remain in the ready position and will not be in the deployed position when it is desired to remove ground anchor 10. In this situation, arms 26 may be returned to the installation position and ground anchor 10 can be easily removed from the ground.

Figure 5:
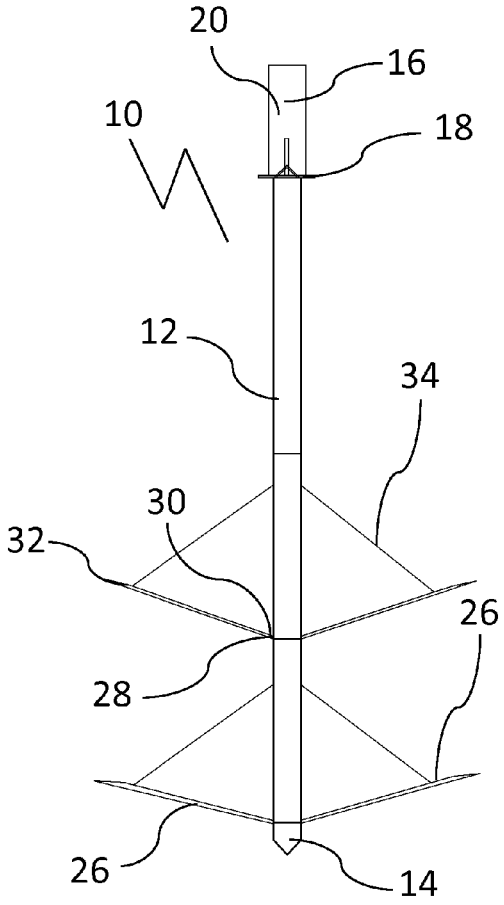
FIG. 5 is a side elevation view of an alternative ground anchor in the deployed position.

Referring to FIG. 5, it can be seen that arms 26 are held in place by a deployed linkage 34. Linkage 34 allows arms 26 to move to the deployed position and holds arms 26 in place once they have deployed. Linkage 34 may be a cord, chain or folding linkage that is attached between arms 26 and anchor body 12. Linkage 34 may also be a solid linkage that slides along a channel in anchor body 12. Linkage 34 may also be in the form of a pivot lock that prevents arms 26 from rotating past a certain point, however the style of linkage 34 shown in FIG. 5 provides more structural support to arms 26 in the deployed position. Referring to FIG. 6, if arms 26 are moved to the deployed position, ground anchor may still be removed by releasing linkage 34, such that arms 26 are permitted to pivot along pivot point 30 to be parallel or substantially parallel to anchor body 12. For convenience, it is preferred that linkage 34 be released from anchor body 12 as shown, rather than from arms 26, to simplify the design. Once removed from the ground, linkages 34 may be re-attached to body 12 to re-use.

Figure 11A:
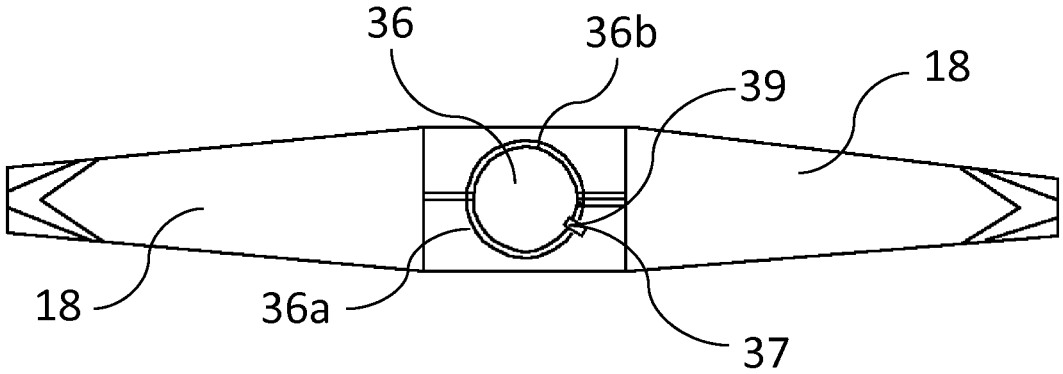
FIG. 11*a* is a top plan view of the ground anchor in an unlocked position.
Figure 11B:
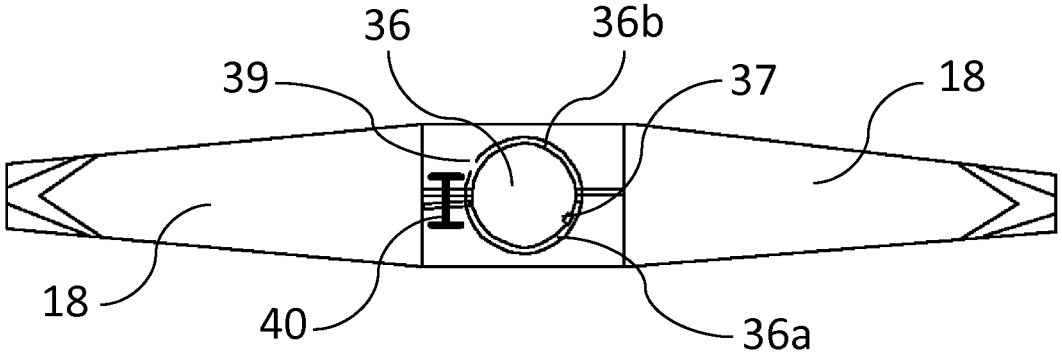
FIG. 11*b* is a top plan view of the ground anchor in a locked position.

In order to move arms 26 between the various positions, actuators are provided. Referring to FIGS. 11*a* and 11*b*, a first actuator 36 is provided in the form of a cylinder 36*a* positioned around a fixed, inner cylinder 36*b* that moves arms 36 from the installation position to the ready position and from the ready position to the installation position. As shown, first actuator 36 is positioned such that it is accessible from the surface when anchor 10 is installed. Another actuator 37, such as a lever as shown, may be provided that releases linkages 34 and permits arms 26 to move from the deployed position to the release position, as shown in FIG. 6. This second actuator 37 may, in some embodiments, be combined with first actuator 36, such that first actuator 36 will have a position for each position, where rotating to a first position represents the installation position, rotating from the first to a second position represents the ready position, and rotating from the second position to the third position represents the release position. It will be understood that actuator 36 may take various forms. Actuator 36 is preferably mechanical, but may also use electrical or magnetic components. While actuator 36 is shown as a rotary actuator, it may also be actuated by a lever, similar to actuator 37 shown in FIGS. 21 and 22. Alternatively, horizontal handles 18 may be hinged and may be used as part of the actuator. As handles 18 are longer, they would provide additional leverage if necessary. As shown, actuator 36 rotates between the ready position shown in FIG. 11*a* and the release position shown in FIG. 11*b*. Actuator 36 may return arms 26 to the ready position by rotating back to the position shown in FIG. 11*a*. Outer cylinder 36*a* has an opening 39 that provides access to actuator 37. However, opening 39 is only aligned with actuator 37 when outer cylinder 36*a* is in the release position. This ensures that arms 26 cannot be released to allow anchor 10 to be removed when outer cylinder 36*a* is in the "ready" position.

Figure 18:
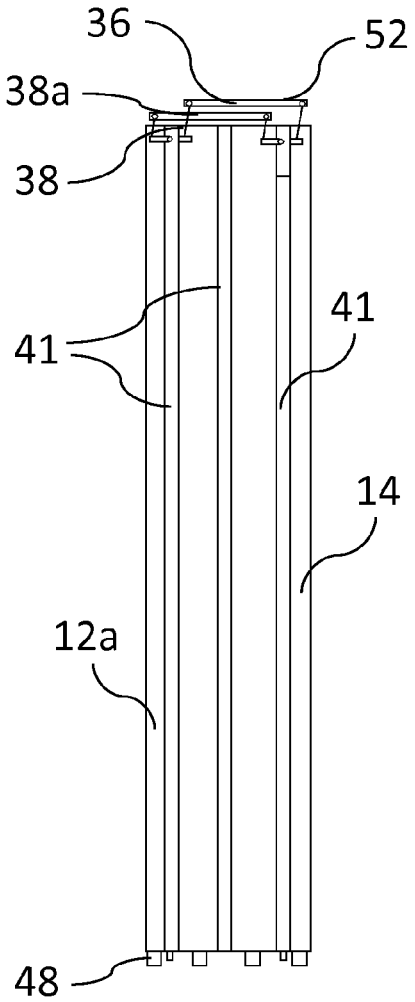
FIG. 18 is a front elevation view in section of the top portion of the ground anchor showing details of the actuator.

Referring now to FIG. 18, actuator 36 shown in FIGS. 11*a* and 11*b* acts on rods 41 in body 14 that rotate to release catches that hold arms 26 in the installation position. A shown, the rotary movement of actuator 36 is converted to rotary movement of rods 38 using lateral bars 52 that move laterally as actuator 36 is turned, and convert this movement into the rotation of rods 41. Other linkages may also be used, such as spring-biased catches, etc., or electrical cables if an electrical/magnetic system is used. A hollow rod 38*a* is positioned between rods 38 and is used to house the cable attached to actuator 37.

Referring to FIG. 11*b*, a lock 40 is preferably provided in order to prevent an unauthorized person from using actuator 36 to return arms 26 to the installation position. In the depicted embodiment, actuator 36 is a rotating actuator, and has a locking profile in the form of an aperture that aligns with an aperture secured to surface end 16 that locks actuator 36 in a specific rotational position. Actuator 36 may then only be moved to either the installation position (if arms 26 have not deployed) or the release position (if arms 26 have deployed) by first releasing the lock.

Figure 12:
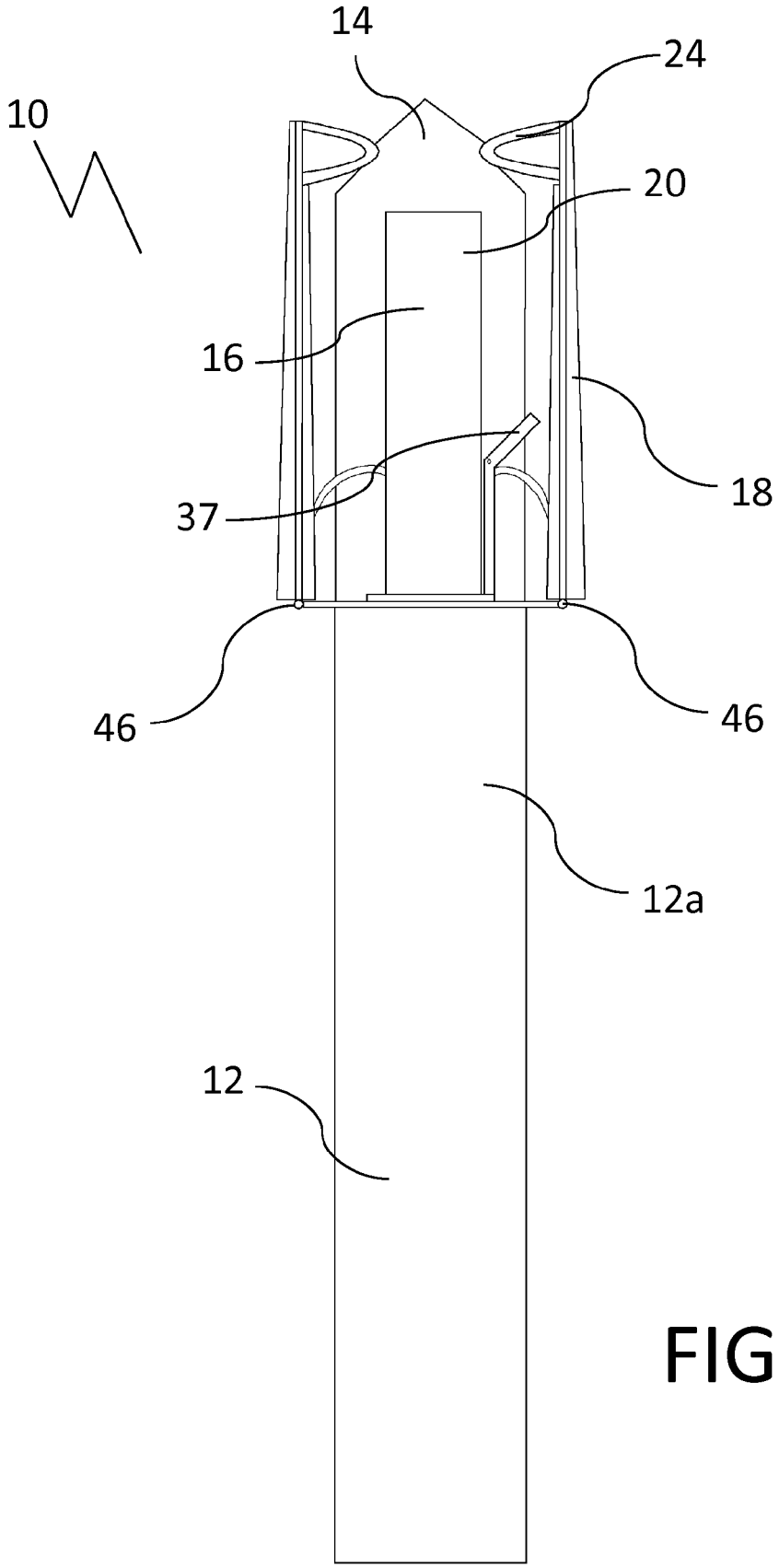
FIG. 12 is a front elevation view of the ground anchor in a collapsed position.
Figure 13:
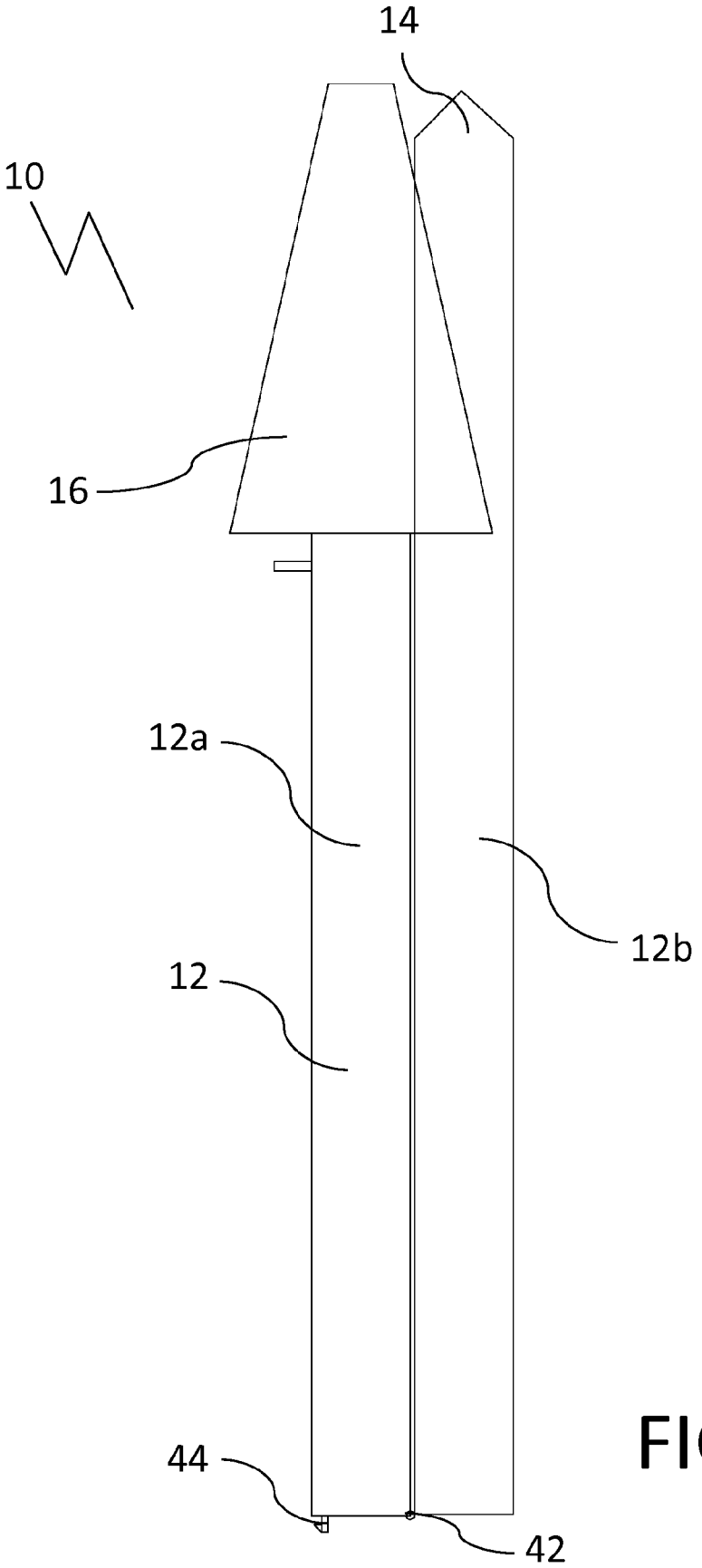
FIG. 13 is a side elevation view of the ground anchor in a collapsed position.
Figure 14:
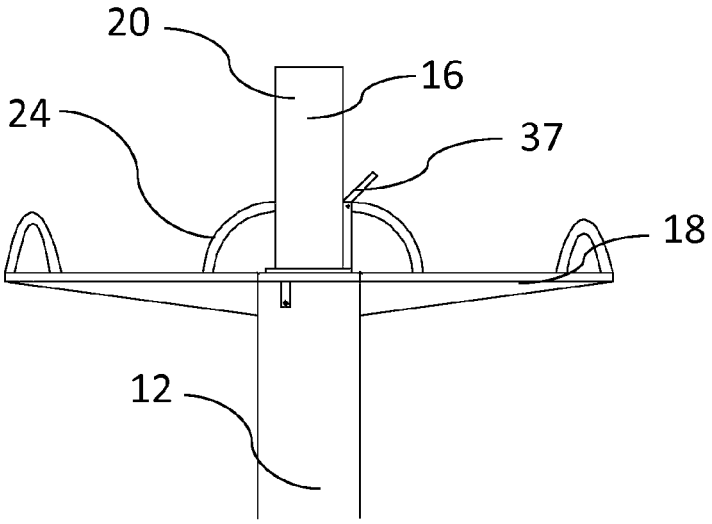
FIG. 14 is a front elevation view in section of a top portion of the ground anchor.
Figure 19:
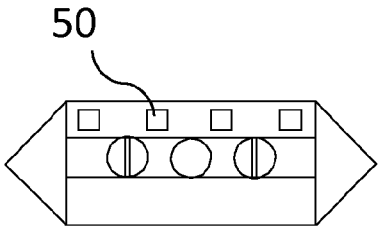
FIG. 19 is a top plan view of the bottom portion of the ground anchor.

Referring to FIGS. 12 and 13, ground anchor 10 is preferably collapsible to reduce the space requirements during transport or storage. As shown, anchor body 12 is made from two portions 12*a* and 12*b* that are connected by a hinge 42 and locked or released by a latch 44. When latch 44 is released, bottom portion 12*b* may be folded up around hinge 42 to the storage position as shown. In addition, horizontal handles 18 may be mounted by hinges 46 that allow them to be folded to reduce the space requirements as well. Referring to FIGS. 18 and 19, body 12 is designed with mating connections that allow rods 41 in upper portion 12*a* to connect with the lower portion 12*b*. As depicted in FIG. 19, this is done by providing a locking profile 48 that is engaged by another mating profile 50 in bottom portion 12*b*. As shown, profiles 48 and 50 include a slot and blade arrangement, although any suitable profile would work that allows the transfer of rotational energy.

Figure 15:
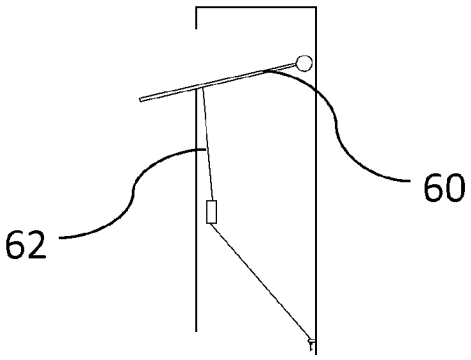
FIG. 15 is a detailed side elevation view of an actuator for releasing the top portion from the bottom portion.
Figure 16:
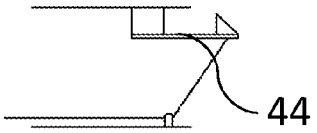
FIG. 16 is a detailed view of a releasable catch that releases the top portion from the bottom portion.
Figure 17:
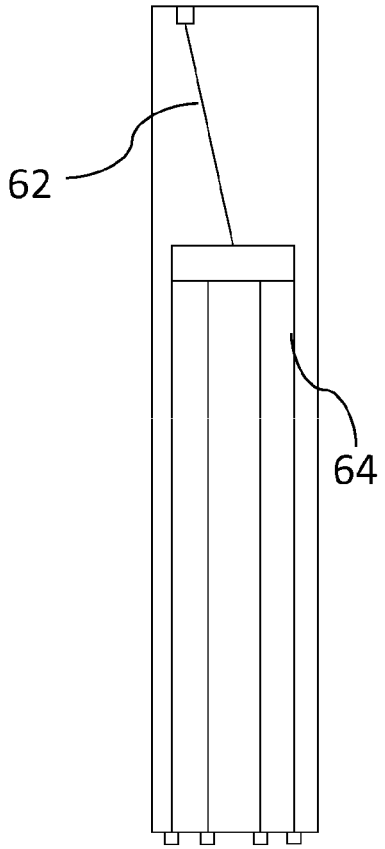
FIG. 17 is a rear elevation view in section of the top portion of the ground anchor showing the release mechanism.
Figure 20:
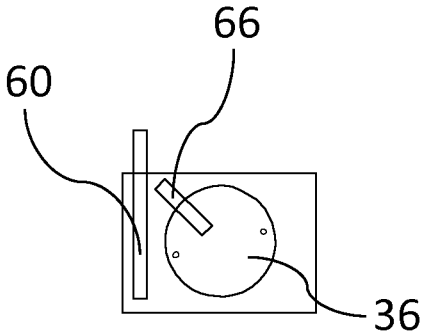
FIG. 20 is a bottom plan view in section of the surface end of the ground anchor.
Figure 21:
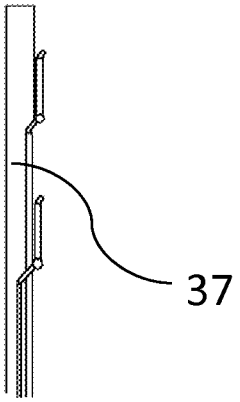
FIG. 21 is a detailed side elevation view of the lever actuator.
Figure 22:
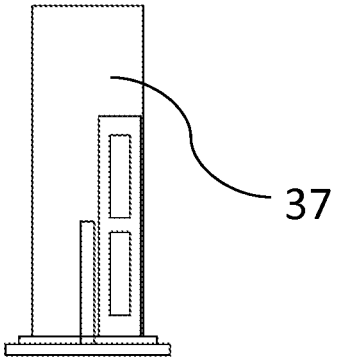
FIG. 22 is a detailed front elevation view of a lever actuator.

Referring to FIGS. 15, 16, and 17, the release mechanism for releasing upper and lower sections 12*a* and 12*b* is shown. Referring to FIG. 15, a lever 60 is provided that applies a force to a cable 62, which is in turn connected to a set of four cables 64, shown in FIG. 17. These cables then pull on latch 44 shown in FIG. 16 out of engagement with the lower portion to allow body 12 to be folded. While a single latch may be sufficient, a stronger connection is preferred such that it does not provide a point of weakness that may fail before arms 26, and make it easier to remove anchor 10 without releasing arms 26 properly. Referring to FIG. 20, it may be preferable to also prevent lever 60 from being actuated when arms 26 are in the ready position. This may be done by providing a flange 66 that turns with actuator 36 and rests above lever 60 to lock it in place, and moves out of the way (as shown in FIG. 20) otherwise. This prevents an unauthorized individual from releasing latches 44, which would only require hinge 42 to be broken in order to remove the top portion of anchor 10 and whatever is secured to it.

Figure 23:
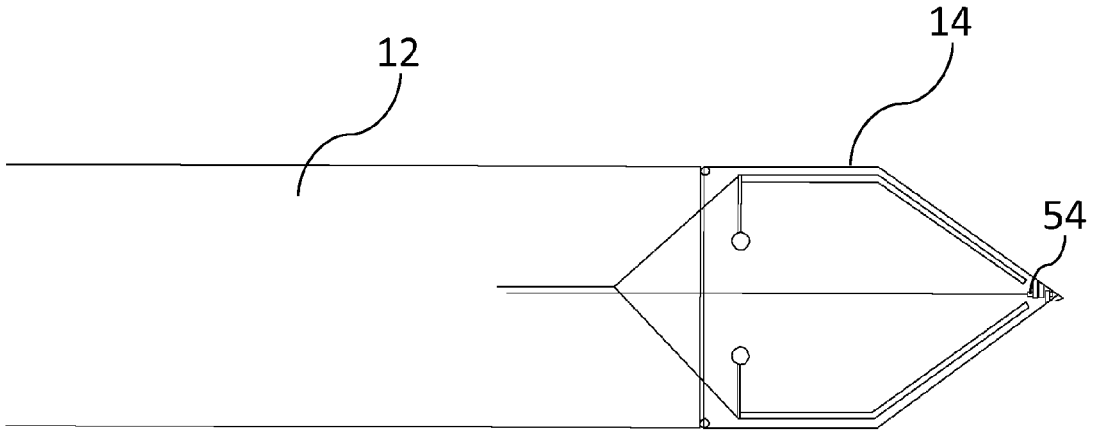
FIG. 23 is a detailed side elevation view in section of an openable version of the ground insertion end of the ground anchor.
Figure 24:
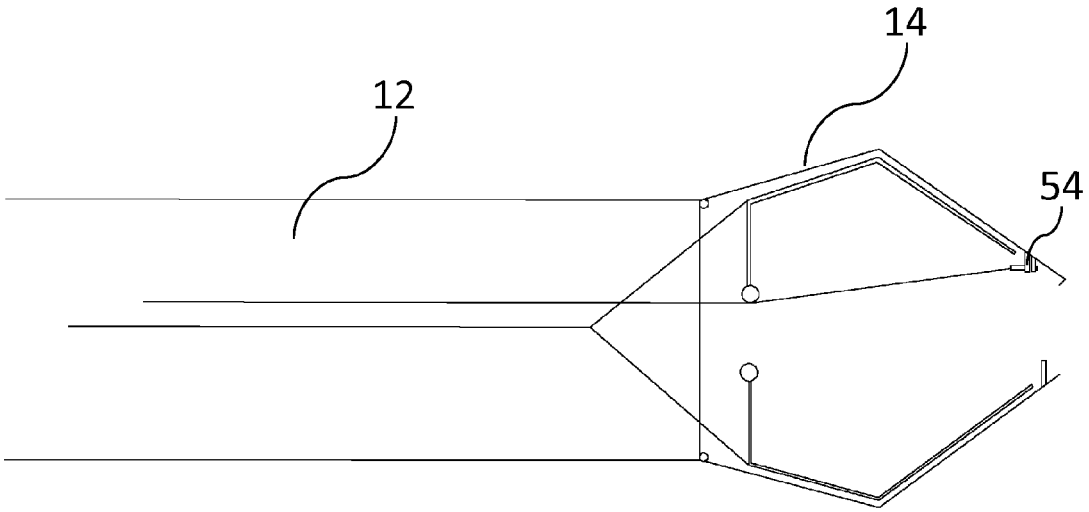
FIG. 24 is a detailed side elevation view in section of the openable version of the ground insertion end of the ground anchor in the open position.

Preferably, body 12 will be made of a lightweight metal, such as aluminum, and be hollow to reduce weight and allow room for the various components to be installed. Referring to FIGS. 23 and 24, in some embodiments, body 12 of ground anchor 10 may fill with the ground material if it is hollow. This may occur in the deployed position, or even in the ready position if arms 26 are pushed out slightly. In order to reduce resistance and weight when removing ground anchor 10, it may be desirable to allow ground insertion end 14 to move between an open and a closed position, such as by releasing a latch 54. This allows ground material to be released from within ground anchor 10 as ground anchor 10 is withdrawn from the ground surface. This may also be beneficial if arms 26 are unable to fully retract when returned to the installation position. In this circumstance, arms 26 may still have some or all of the deployment profile exposed to the ground surface in the installation position. While arms 26 will not be permitted to deploy, ground material may still engage arms 26. By allowing the ground material to flow through body 12, resistance to ground anchor 10 may be reduced as it is pulled out from the ground surface.

Figure 25:
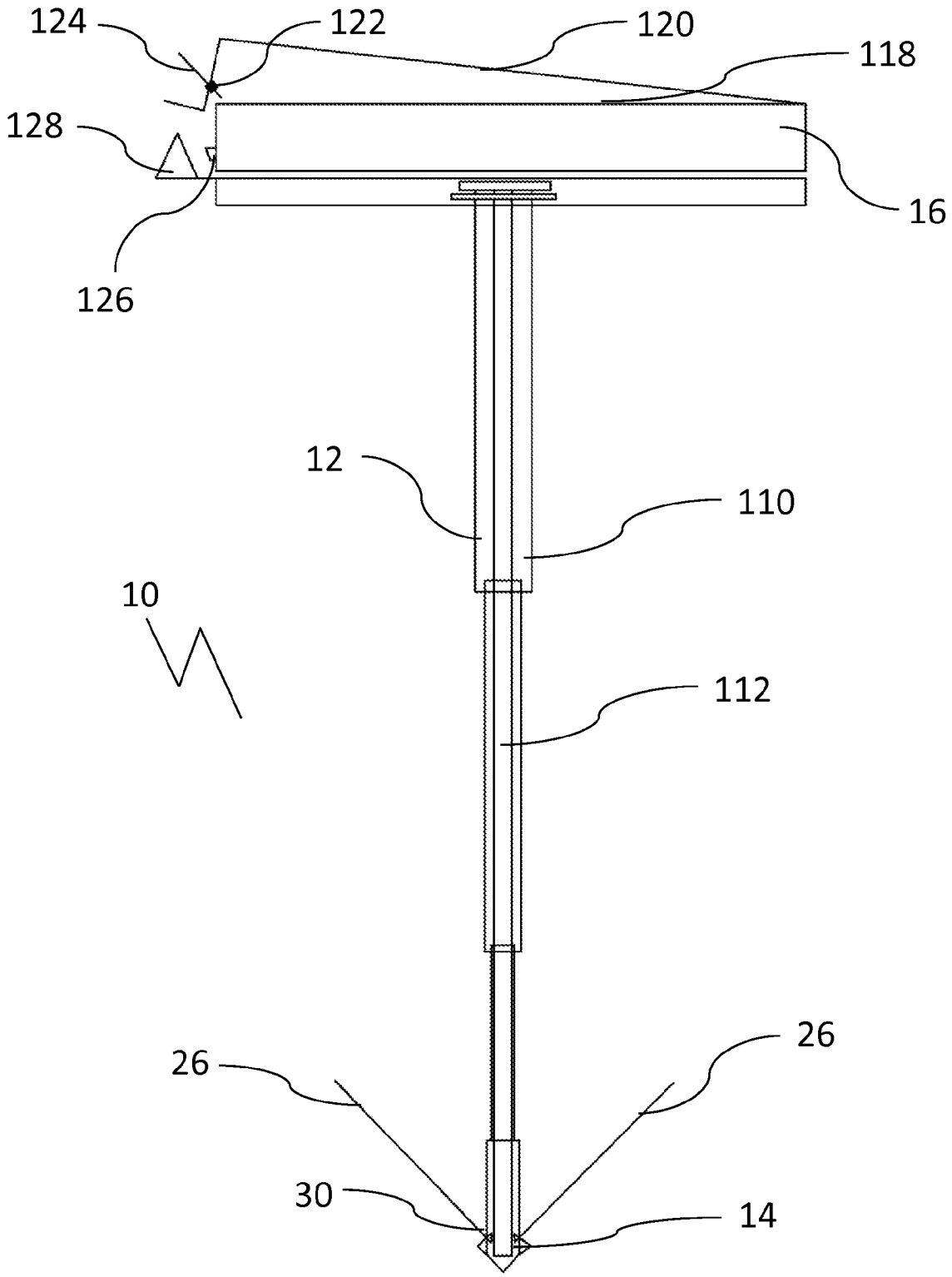
FIG. 25 is a side elevation view of an alternate ground anchor.
Figure 26:
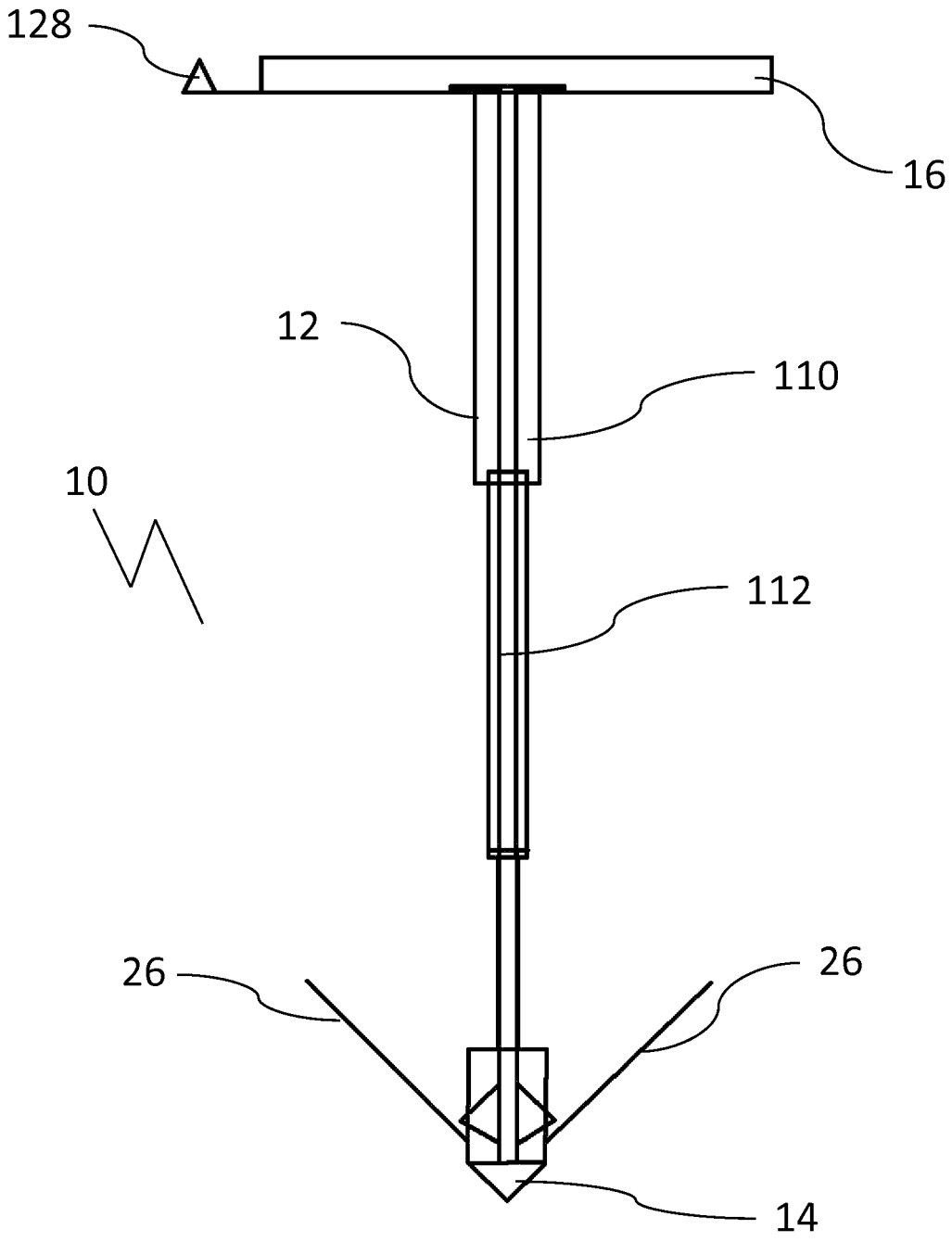
FIG. 26 is a side elevation view in section of the alternate ground anchor.

Referring now to FIGS. 25 through 32, an alternate embodiment will be described, using the same reference numbers for equivalent components. As shown in FIG. 25 and FIG. 26, ground anchor 10 has an anchor body 12 with a ground insertion end 14 and a surface end 16, as above. Ground anchor 10 has one or more arms 26 that pivot about a pivot point 30. In this embodiment, anchor body 12 has an exterior telescoping portion 110, and an actuation bar 112. Actuation bar 112 may be a continuous solid pole, or it may be a collapsible portion, such as a segmented pole connected by elasticated connecting members. Ground anchor 10 can be inserted into the ground with telescoping portion 110 extended, and actuation bar 112 inserted, allowing the anchor body 12 to be inserted into the ground. As anchor body 12 is inserted, arms 26 are retracted into anchor body 12, as described above. Once telescoping portion 110 is installed, actuation bar 112 is inserted to activate arms 26. Actuation bar 112 may place arms 26 in an intermediate, or ready position, as described above. If an upward force is applied to ground anchor 10 in this position, arms 26 will be moved to the deployed position shown in FIG. 25.

Figure 30:
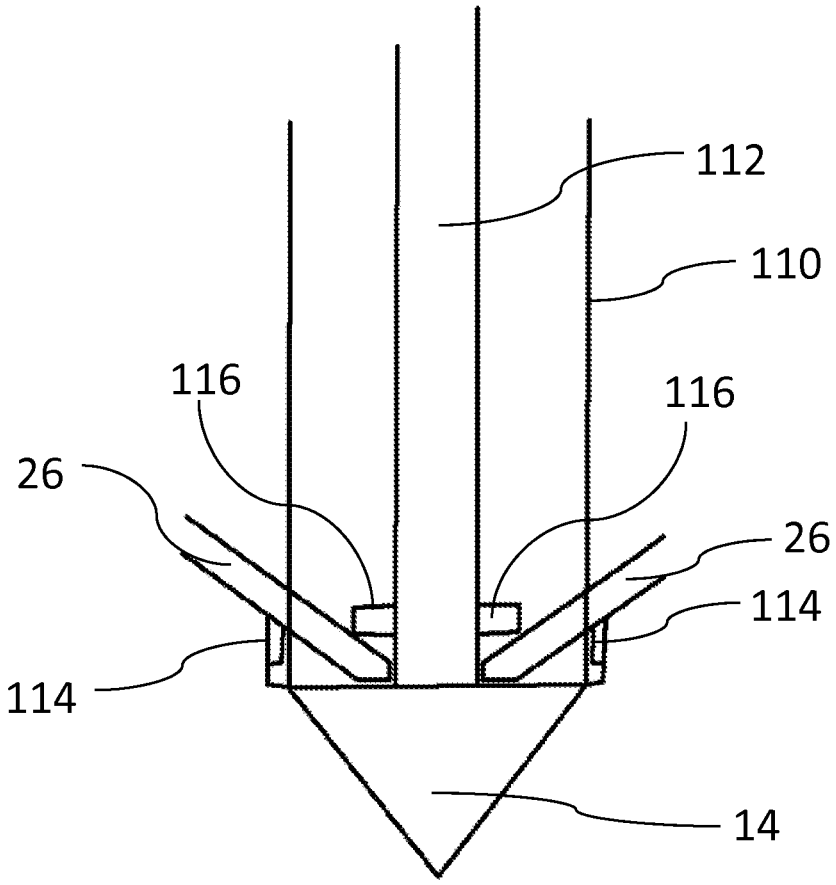
FIG. 30 is a detailed side elevation view in section of the bottom of an alternate ground anchor.
Figure 31:
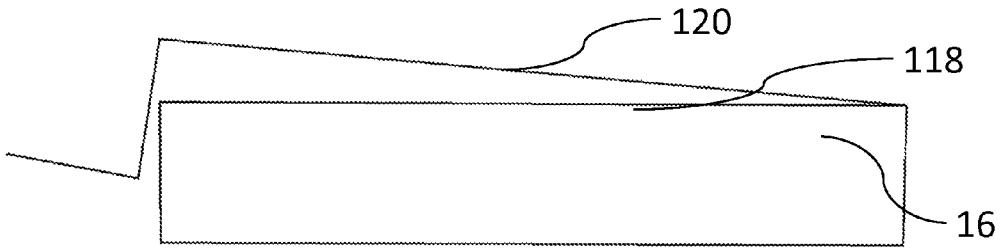
FIG. 31 is a side elevation view in section of an alternate release mechanism.

Referring to FIG. 30, in the deployed position arms 26 will be prevented from further pivotal movement by stops 114 carried by telescoping portion 110, and stops 116 carried by actuation bar 112. In order to release ground anchor 10 from the ready position or the deployed position, actuation bar 112 is removed through surface end 16. When actuation bar 112 is removed, arms 26 will no longer be held between stops 116 and stops 114, and will therefore be permitted to move to a retrieval position, similar to what is shown in FIG. 6 and no longer prevent upward movement of ground anchor 10. Preferably, arms 26 are tethered to telescoping portion 110 and are pulled behind telescoping portion 110 as it is removed. The tether (not shown) may be a rigid, pivotal linkage, a mesh wire or mesh surface, a flexible cord or cable, or other suitable attachment as will be known in the art.

Figure 28:
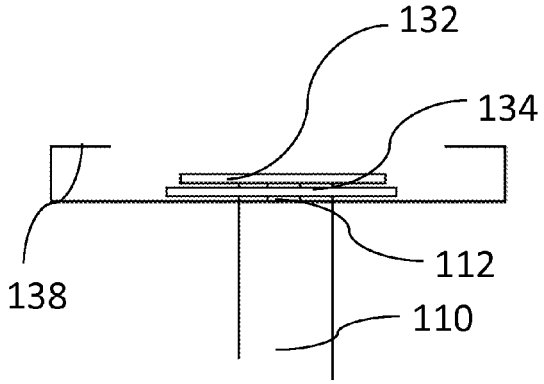
FIG. 28 is a detailed front elevation view in section of the top of an alternate ground anchor.

Referring to FIG. 28, actuation bar 112 may have an upper portion 132 that aids in removal of actuation bar 112. Telescoping portion 110 may also be removable, and have an upper portion 134. Referring to FIG. 25, surface end 16 has a removal opening 118 through which actuation bar 112 may be removed. Removal opening 118 is closed by cover 120 when ground anchor 10 is in use in the ground to prevent actuation bar 112 from unauthorized removal. Alternatively, actuation bar 112 may be locked directly to either surface end 16 or telescoping portion 110. Cover 120 may have a variety of locking mechanisms 122 as known in the art, the locking mechanisms preventing an unauthorized user from removing actuation bar 112. In FIG. 25, cover 120 is a pivotal lid and locking mechanism 122 features a pin 124 that engages a protrusion 126 to prevent movement of cover 120, and a loop 128 that can receive a lock (not shown) to prevent pin 124 from being disengaged from protrusion 126 when cover 120 is pivoted to the closed position.

Figure 27:
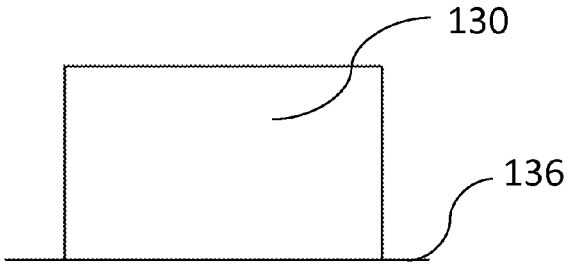
FIG. 27 is a detailed front elevation view in section of the top box portion of the alternate ground anchor.
Figure 29:
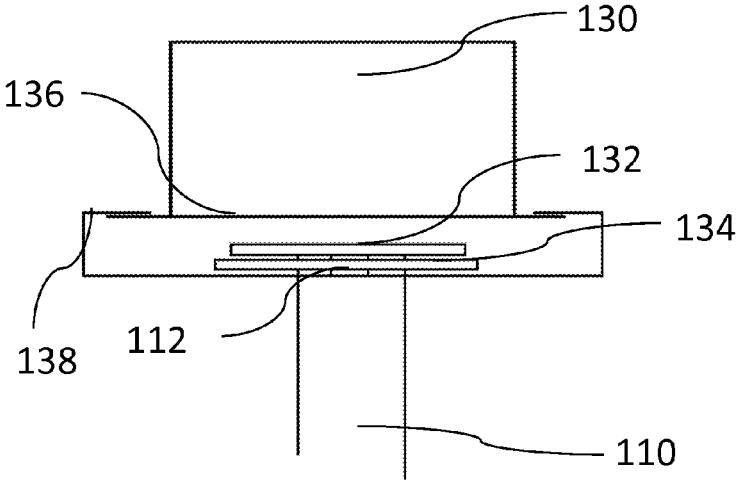
FIG. 29 is a detailed front elevation view in section of an assembled alternate ground anchor.
Figure 32:
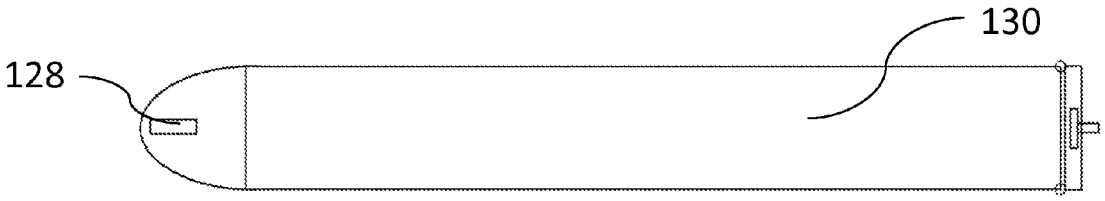
FIG. 32 is a top plan view of the alternate ground anchor.

Referring to FIG. 27, surface end 16 may have a storage box 130 as a component of ground anchor 10. Referring to FIG. 29, box 130 can be slid onto the second component of surface end 16 as shown in FIG. 29. Box 130 may have an engagement surface 136 that slides underneath a second engagement surface 138 to prevent upward removal of box 130. Box 130 may then be locked in place using loop 128. Engagement surface 136 of box 130 may also prevent actuation bar 112 from moving upward and releasing arms 26. Referring to FIG. 32, box 130 may be used to contain the components of ground anchor 10 when not in use. Telescoping portion 110 can be collapsed from an extended position to a collapsed position when actuation bar 112 is removed to fit within box 130. Actuation bar 112 may also be segmented such that it is sized to fit within box 130.

Figure 10A:
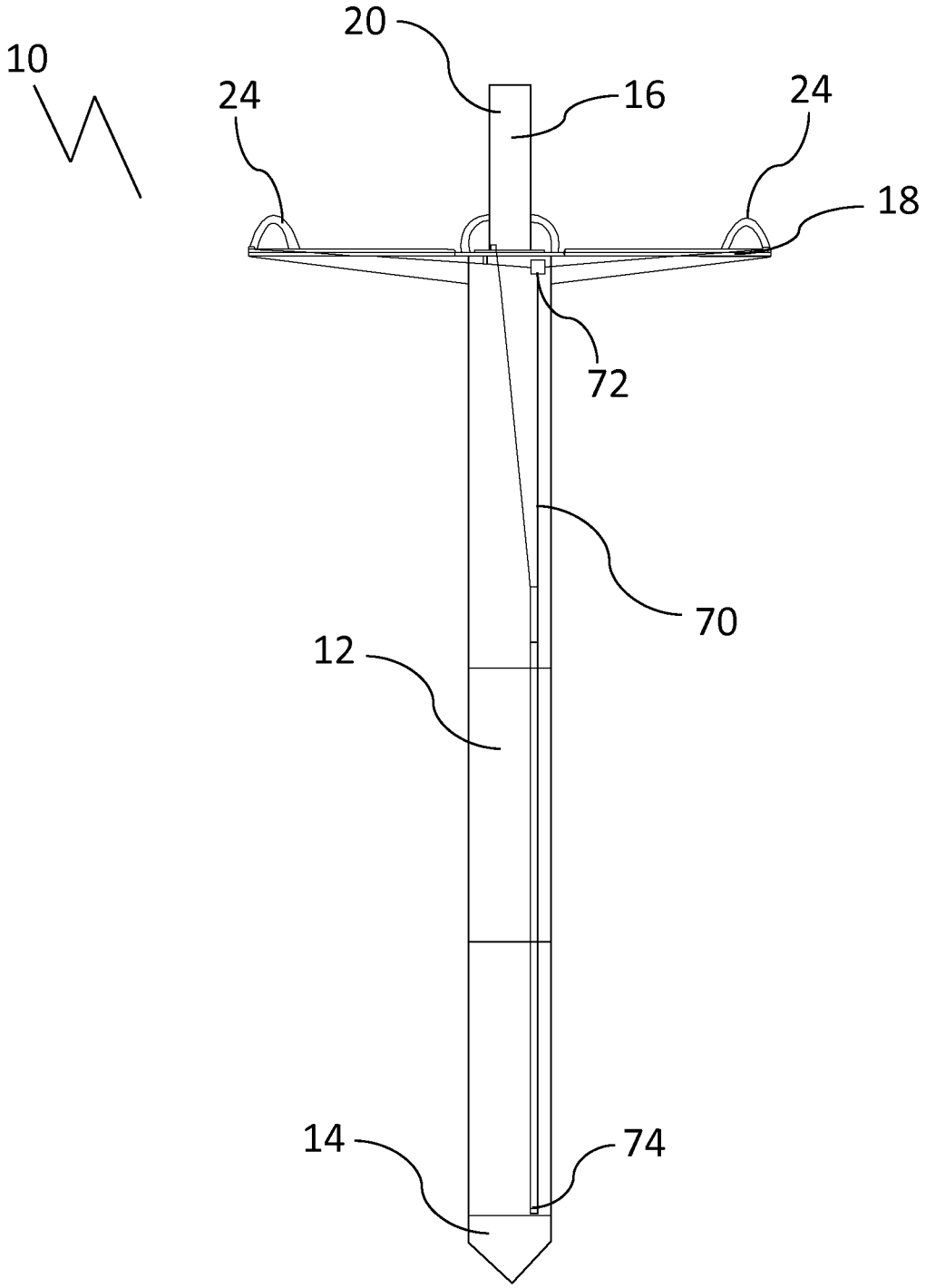
FIGS. 10*a*-10*c* are front elevation views in section of an electrical alarm system of the ground anchor.
Figure 10B:
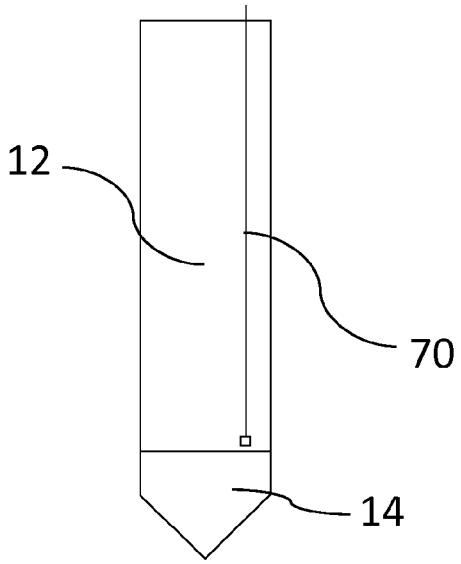
Figure 10C:
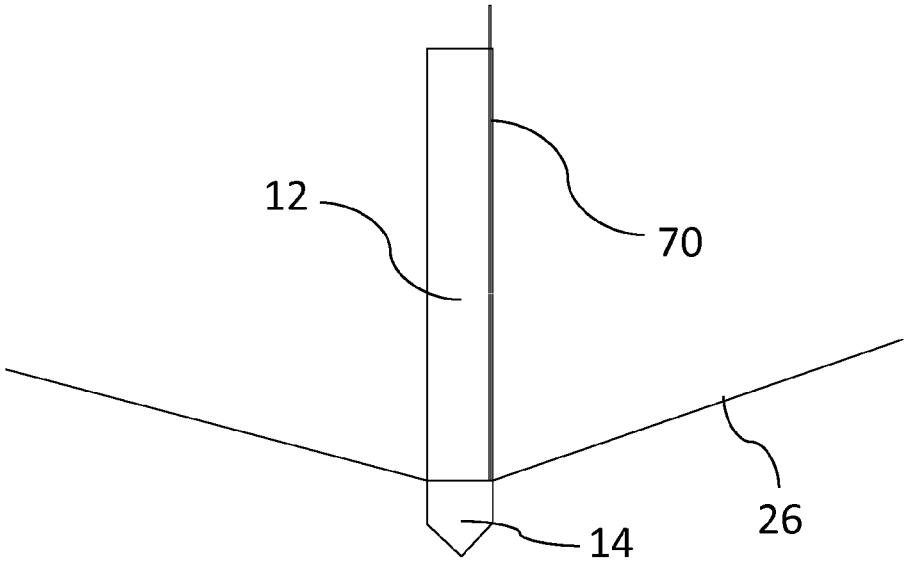

In some circumstances, it may be desirable to provide an alarm with ground anchor 10 that sounds when arms 26 are deployed. Referring to FIGS. 10*a*, 10*b*, and 10*c*, an electrical circuit 70 is shown. A first connection 72 is made when actuator 36 is moved to the ready position, and a second electrical connection 74 is made when arms 26 move to the deployed position. Once both connections 72 and 74 are made, an alarm will sound, either audible, visual, or other, depending on the preferences of the use. The alarm may then be deactivated by turning actuator 36 to the installation position, which breaks first connection 72 and therefore the circuit 70.

Ground anchor 10 as described is preferably used in sand, such as at a beach, however it may also be used in other ground materials, such as dirt, gravel, or any other material into which body 12 can be inserted and arms 26 can be deployed. The actual design may vary depending on the type of ground material. For example, beach sand is generally more granular and will receive body 12 more easily compared to a dirt setting, but is also easier to manipulate in order to attempt to remove. Accordingly, an anchor designed for a beach may be longer and thicker with larger arms 26, while an anchor designed for dirt may be shorter and narrower with arms 26 that do not extend out as far, as it will be more difficult to have them pivot around pivot points 30. The actual dimensions can be determined by a person of ordinary skill and based on the intended use.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A ground anchor, comprising:

an anchor body having a ground insertion end and a surface end, in use the ground insertion end being inserted into a ground surface and the surface end remaining accessible from above the ground surface;

one or more arms, each arm having a first end that is pivotally connected to the anchor body at a pivot point and a second end opposite the first end, the one or more arms having a ready position, a deployed position, and a retrieval position, wherein the deployed position is an intermediate pivotal position between the ready position and the retrieval position, wherein, in a direction perpendicular to the anchor body, the second end of each arm is spaced outward from the anchor body a greater distance in the deployed position that in the retrieval position; and a first actuator that releases the one or more arms to move to the retrieval position, wherein:

in the ready position, an upward force applied to the anchor body causes the deployment profile to engage the ground material, the ground material causing the one or more arms to move to the deployed position in which the one or more arms extend outward from the anchor body and into the ground material; and when the first actuator is actuated, a further upward force applied to the anchor body causes the one or more arms to move to the retrieval position.

2. The ground anchor of claim 1, wherein the anchor body is a hollow body and the first actuator is an actuator bar that is inserted within the hollow body, the actuator bar having a lower engagement profile that moves the arms from an installation position to the ready position and secures the arms when in the deployed position.

3. The ground anchor of claim 1, wherein the anchor body is a hollow body and the first actuator is an actuator bar that is inserted within the hollow body and the arms are released from the deployed position by removing the actuator bar.

4. The ground anchor of claim 1, wherein the ground insertion end is telescopic and removable from the surface end.

5. The ground anchor of claim 1, wherein the first actuator comprises a locking profile that, when engaged, prevents the first actuator from being actuated and releasing the arms from the deployed position.

6. The ground anchor of claim 1, wherein the anchor body comprises a first section and a second section and the anchor body is collapsible.

7. The ground anchor of claim 1, wherein the surface end comprises one or more flanges that extend out from the anchor body, the one or more flanges comprising locking profiles for selectively locking objects to the anchor body.

8. The ground anchor of claim 1, wherein, in the ready position, the one or more arms are free to pivot about the pivot point to the deployed position.

9. The ground anchor of claim 1, further comprising an alarm circuit that is activated when the first actuator is actuated to the ready position and the arms are deployed.

10. The ground anchor of claim 1, wherein the one or more arms further comprise an installation position and the first actuator further moves the arms from the installation position to the ready position.

11. A method of providing a ground anchor, comprising:

providing:

an anchor body having a ground insertion end and a surface end;

one or more arms, each arm having a first end that is pivotally connected to the anchor body at a pivot point and a second end opposite the first end, the one or more arms having a ready position, a deployed position, and a retrieval position, the one or more arms having a deployment profile;

inserting the ground insertion end into a ground surface such that the surface end remains accessible from above the ground surface, the one or more arms being in the ready position such that the one or more arms extend along the anchor body from the pivot point toward the surface end;

using a first actuator, selectively releasing the one or more arms from the ready position;

applying an upward force to the anchor body in the ready position, such that the deployment profile engages the ground material and such that the ground material causes the one or more arms to move to the deployed position in which the one or more arms extend outward from the anchor body and engage the ground material; and with the first actuator having released the one or more arms, applying a further upward force to the anchor body such that the one or more arms move to the retrieval position.

12. The method of claim 11, wherein the anchor body is a hollow body and the first actuator is an actuator bar that is inserted within the hollow body, the actuator bar having a lower engagement profile that moves the arms from an installation position to the ready position and secures the arms when in the deployed position.

13. The method of claim 11, wherein the anchor body is a hollow body and the first actuator is an actuator bar that is inserted within the hollow body and the arms are released from the deployed position by removing the actuator bar.

14. The method of claim 11, wherein the ground insertion end is telescopic and removable from the surface end.

15. The method of claim 11, wherein the first actuator comprises a locking profile that, when engaged, prevents the first actuator from releasing the arms from the deployed position.

16. The method of claim 11, wherein the anchor body comprises a first section and a second section and further comprising the step of collapsing the anchor body.

17. The method of claim 11, wherein the surface end comprises one or more flanges that extend out from the anchor body, the one or more flanges comprising at least one locking profile, and further comprising the step of locking an object to at least one of the locking profiles.

18. The method of claim 11, wherein, in the ready position, the one or more arms are free to pivot about the pivot point to the deployed position.

19. The method of claim 11, comprising the step of sounding an alarm when the arms move to the deployed position.

20. The method of claim 12, wherein, if the one or more arms are not moved to the deployed position, the arms are moved from the ready position to the installation position using the first actuator and the anchor body is removed from the ground.

* * * * *